US009265288B2

(12) United States Patent
Mazourik et al.

(10) Patent No.: US 9,265,288 B2
(45) Date of Patent: Feb. 23, 2016

(54) FUNCTIONAL BRASSIERE

(71) Applicants: Sergei Mazourik, Delemont (CH); Oksana Mazourik, Delemont (CH); Katharina Mazourik, Delemont (CH); Michael Mazourik, Delemont (CH)

(72) Inventors: Sergei Mazourik, Delemont (CH); Oksana Mazourik, Delemont (CH); Katharina Mazourik, Delemont (CH); Michael Mazourik, Delemont (CH)

(73) Assignee: Sergei Mazourik (CH)

( * ) Notice: Subject to any disclaimer, the term of this patent is extended or adjusted under 35 U.S.C. 154(b) by 99 days.

(21) Appl. No.: 13/977,245

(22) PCT Filed: Dec. 11, 2012

(86) PCT No.: PCT/CN2012/086384
§ 371 (c)(1),
(2) Date: Jun. 28, 2013

(87) PCT Pub. No.: WO2014/089762
PCT Pub. Date: Jun. 19, 2014

(65) Prior Publication Data
US 2014/0162531 A1 Jun. 12, 2014

(51) Int. Cl.
*A41C 3/00* (2006.01)

(52) U.S. Cl.
CPC ..... *A41C 3/0071* (2013.01); *A41C 3/0028* (2013.01)

(58) Field of Classification Search
CPC ..... A41C 3/00
USPC ..... 450/14–17, 23, 25, 30, 31, 27, 28, 58, 450/79, 85, 64, 91; 2/104, 106, 96, 102, 2/109, 110, 114
See application file for complete search history.

(56) References Cited

U.S. PATENT DOCUMENTS

| | | | | | |
|---|---|---|---|---|---|
| 1,288,927 | A * | 12/1918 | Kops | 450/79 |
| 1,417,930 | A * | 5/1922 | Mailleue | 623/7 |
| 3,040,750 | A * | 6/1962 | Hurwitz | 450/58 |
| 3,094,125 | A * | 6/1963 | Lewis | 450/59 |
| 3,826,266 | A * | 7/1974 | Alpert | 450/11 |
| 4,185,332 | A * | 1/1980 | Jahnig | 623/7 |
| 4,269,191 | A * | 5/1981 | Evans | 450/64 |
| 6,220,924 | B1 * | 4/2001 | Kobayashi et al. | 450/9 |
| 6,402,586 | B1 * | 6/2002 | Winik et al. | 450/78 |
| 6,604,983 | B1 * | 8/2003 | Denn | 450/1 |

* cited by examiner

*Primary Examiner* — Gloria Hale
(74) *Attorney, Agent, or Firm* — Bryant J. Keller; Kirton | McConkie

(57) ABSTRACT

A functional garment comprises a first breast cup and a first cross strap, two opposite ends of which are attached to the inner and outer edges of the first breast cup, respectively. The functional garment can be used to simultaneously provide both orthopedic and breast augmentation benefits. A plurality of countervailing forces simultaneously provide force on the shoulders, to bring them back and/or the shoulder blades closer together, and the breasts, to bring them closer together and/or lift them.

20 Claims, 4 Drawing Sheets

FUNCTIONAL BRASSIERE

FIELD OF THE INVENTION

This invention relates to a functional brassiere (a functional garment), more specifically a functional brassiere that simultaneously provides orthopedic benefits and visual breast enhancement.

BACKGROUND OF THE INVENTION

An increase in visual appearance leads to many well-known benefits. Such benefits include an increase of self-esteem and confidence, which results in further physiological and physical benefits. Because of such cascading benefits, many garments have been developed and produced to increase one's physical appearance. One such class of garments is the push-up brassiere. The push-up bra elevates and draws the breasts together. This results in outlining the breast by way of creating cleavage and gives the appearance of an increased breast size.

Though currently known push-up bras increase visual appearance, they decrease physical health. The laws of physics state that every action leads to a counteraction. The design of a typical push-up bra includes a pair of cups, a pair of shoulder straps statically fixed to each cup, and a back strap statically fixed to each strap and shoulder strap. With the strap as the primary or only option for placing force on the breasts, the upward force lifting the breast must be counteracted by the shoulder straps pulling the shoulders downward. These countervailing forces lead to increased static and dynamic pressure or load on the shoulder girdle, back, and neck. This increased load leads to the wearer developing incorrect posture and stoop. Further disadvantaged results of wearing a typical push-up bra are protruding the thoracic section of the spine backwards, bending the head forward, flattening the chest, bringing the shoulders together, rounding the back, protruding the stomach forward, and protruding the shoulder-blades from the back. Incorrect posture can lead to alterations in one's overall skeletal structure, motor apparatus disorder, headaches, and malfunctions of the respiratory, nerve, and cardiovascular systems. Stoop leads to a droopy abdomen, spine aches, weakening of the sural and hip muscles, reduced waist mobility, flaccid face skin, appearance of a second chin, etc.

To improve posture and combat stoop, orthopedic bras have been developed. These orthopedic bras bring the shoulders back and shoulder blades together, thereby decreasing the pressure on the shoulders, back, and neck. Though an orthopedic bra has physical benefits, it results in reduced breast aesthetics. One result of pulling one's shoulders back is that the appearance of cleavage is greatly reduced and one's breasts begin to point outward, rather than forward.

Based on the problems given above and other problems, there is a need to correct one's posture and prevent stoop while also accentuating and increasing one's visual appearance.

SUMMARY OF THE INVENTION

It is an object of the present invention to provide a novel functional brassiere and its application.

In the first aspect, the present invention provides a functional garment comprising:

a first breast cup; and a first cross strap, one end of which is attached to an inner edge of the first breast cup and an opposite edge of which is connected to an outer edge of the first breast cup.

In another exemplary embodiment, the functional garment further comprising:

a first shoulder loop attached to the outside edge of the first breast cup;

a second breast cup;

a second shoulder loop attached to an outside edge of the second breast cup;

a second cross strap, one end of which is attached to an inner edge of the second breast cup and an opposite edge of which is connected to the outer edge of the second breast cup.

In another exemplary embodiment, the functional garment further comprising: a first breast cup connector and a first shoulder loop, the first breast cup connector being located between the first breast cup and the first shoulder loop and the first cross strap.

In another exemplary embodiment, the functional garment further comprising: a first cross strap connector, at least partially located at some point along the length of the first cross strap.

In another exemplary embodiment, the functional garment further comprising: a second cross strap and a second cross strap connector, wherein both the first and second cross strap connectors are located along the same side of a user's body.

In another exemplary embodiment, the functional garment further comprising: a first cross strap angling along a portion of the first cross strap and lower than a user's breast, wherein an angle of the first cross strap angling is an obtuse angle.

In another exemplary embodiment, the functional garment further comprising: a buckle located at the intersection of the first and second cross straps.

In another exemplary embodiment, the functional garment further comprising: a cross cut band connected to the first cross strap, the cross cut band circumscribing a user's body and passing under a user's breasts and horizontally along a user's back.

In another exemplary embodiment, the functional garment further comprising: a supporting and/or shaping structure, wherein the end of the first cross strap is connected to the inner edge of the supporting and/or shaping structure instead of the inner edge of the first breast cup.

In the second aspect, the present invention provides a single breast garment comprising:

a first breast cup;

a first cross strap connected to the first breast cup, either directly or via a first breast cup connector; and a cross strap fastener, a portion of which is on an opposite end of the first cross strap as that connected to the first breast cup and another portion of which is on the inner edge of the breast cup, which is on an opposite side of the breast cup as that which the first cross strap is connected.

In the third aspect, the present invention provides a method of simultaneously providing orthopedic benefits and breast enhancement, the steps comprising:

placing a first force on one's shoulders in such a way as to bring one's shoulders back and/or bring one's shoulder blades closes together; and placing a second force on one's breasts in such a way as to bring one's breasts closer together and/or to lift a user's breasts, wherein the first and second forces are countervailing forces.

In the fourth aspect, the present invention provides a use of the functional garment of the first aspect to simultaneously provide orthopedic benefits, by bringing one's shoulders back and/or one's shoulder blades closer together, and visually enhancing one's breasts, by bringing one's breasts closer together and/or lifting one's breasts.

BRIEF DESCRIPTION OF THE FIGURES

Embodiments of the present invention will be described with reference to the Figures. However, these embodiments are not intended to limit the scope of invention.

DETAILED DESCRIPTION OF THE PREFERRED EMBODIMENTS

The description below only lists specific embodiments of the invention. The descriptions are to be read in light of what is commonly known in the art. All features or steps commonly known or obvious to be included with this invention are to be read into the text of this document. Other configurations or features that are obvious or commonly known are to be deemed as part of the scope of this invention.

One realized benefit of the current invention is increasing the visual appearance of a wearer's breasts while simultaneously maintaining or correcting one's posture and/or. This is accomplished, at least in part, due to the claimed invention, some embodiments of which are described below.

In one embodiment of the invention, a method is provided. Though the method will be described as a series of steps, it should be noted that the steps can be performed in any order, in groups, simultaneously, or any combination thereof. One step involves the placing of a force on one's shoulders so that the shoulder blades are brought closer together. This force can be a force towards the posterior of a wearer's body. An example of such pressure is a pulling back of the shoulders.

Another step of the method is placing a force on a user's breasts such a way that they are brought together and/or lifted. This force can be a pulling force on the breast towards the medial line of a user.

In a preferred embodiment of the method, the forces of the two steps are countervailing forces of each other. Essentially the breast pulls on the shoulder while the shoulder pulls on the breast. In an embodiment, the countervailing forces are not in the same plane. In fact, the body can act as a pulley, changing the direction of the countervailing forces around it. In this preferred embodiment, a pulling force is applied to the inner second breast and the second shoulder, the direction of force being changed around the first side of one's body. A pulling force may also be applied to the inner first breast and the first shoulder, the direction of force being changed around the second side of one's body. An example force is a strap made of a hard stretch material or resilient material wrapped around a person's body and connecting the inner portion of a breast cup, closer to the median line of a person, with the outer portion of a breast cup, closer to the distal end of a person. The inner breast can be defined as the side of the breast along the median line of one's body; the two inner breasts may touch when the force is applied, thereby causing cleavage.

Figure 9:
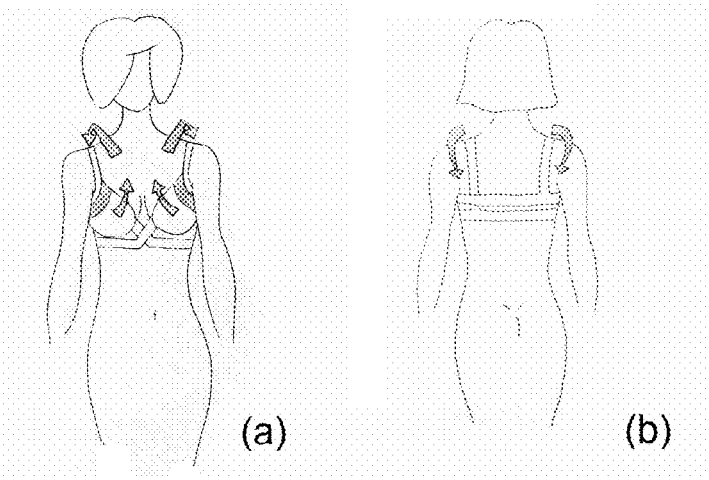
FIG. 9 provides a front and back view of an embodiment of the directional forces.

A visualized embodiment of the direction of the forces is provided in FIGS. 9*a* and 9*b*. The forces are in the direction of the arrows.

In another embodiment of the invention, a secondary shoulder force is applied to the system. This force can work in cooperation with or independently of the first shoulder force. The second shoulder force can either place a force to adjust one shoulder posterior and/or to place the shoulder blades closer together. An example force is a shoulder loop made of a resilient or hard stretch material. The shoulder loop, for example, may attach to the top of the breast cup, loop over the superior portion of one's shoulder, and connect to a strap running along one's back. The strap running along ones back may be a portion of an embodied strap described above or below for providing the two forces.

In another embodiment of the invention, the force placed on the breast is applied to a pad of a bra. The pad is able to move independently of the cup. The shoulder force may still be applied by a strap connected to the outer, distal, side of the cup. The countervailing nature of the forces will still be maintained, even though the bra pad may move while the cup remains static or moves minimally. Either the outer, distal, breast may provide the necessary resilience or non-slip material in the bra pad or along the strap may be used.

Figure 1:
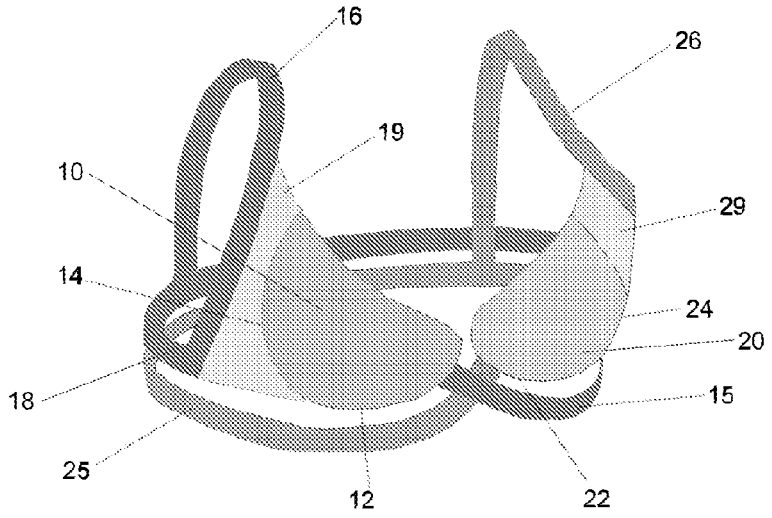
FIG. 1 provides a perspective view of a fastened embodiment of the invention.

One embodiment of the invention is provided in FIG. 1. The embodiment has a first breast cup 10 and a second breast cup 20, hereinafter generally referred to as breast cup. Each breast cup is constructed to conform to at least a portion of a wearer's breast. The breast cup can cover the entire breast or a portion of the breast. If the breast cup covers a portion of the breast, one embodiment of the invention covers the outer and lower portions of the breast. This leaves a portion of the breast exposed for increasing a wearer's appearance while providing adequate support and coverage. The first breast cup 10 may further comprise a first lower inner edge 12 and a first upper outer edge 14. The second breast cup 20 may further comprise a second lower edge 22 and a second upper edge 24.

FIG. 1 further shows an embodiment of the first shoulder loop 16 and the second shoulder loop 26. The first shoulder loop 16 and the second shoulder loop 26 connect to the first breast cup 10 and second breast cup 20, respectively, via the first breast cup connector 19 and the second breast cup connector 29, respectively. Alternatively, the first shoulder loop 16 and second should loop 26 may connect directly to the first breast cup 10 and the second breast cup 20, respectively. At least a portion of the second breast cup connector 29 is attached to the second upper edge 24. Essentially opposite the portion of the second breast cup connector 29 connected to the second upper edge 24, the second shoulder loop 26 is attached. At least a portion of the first breast cup connector 19 is attached to the first upper edge 14. The shoulder loops may be made of a resilient or hard stretch material. The shoulder loops are also designed in such a way that they allow for the user to comfortably pass their arm through the opening while providing support of the bra and assisting in providing a sufficient force on the shoulders. The force should be capable of pulling the shoulders back so that a wearer's shoulder blades are immediately brought closer together. The shoulder loops may further assist in immediately reducing stoop in a wearer.

Figure 3:
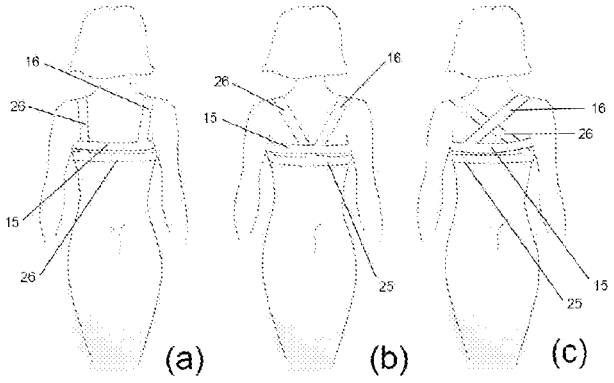
FIG. 3 provides a back view of various embodiments of the shoulder strap configurations.
Figure 5:
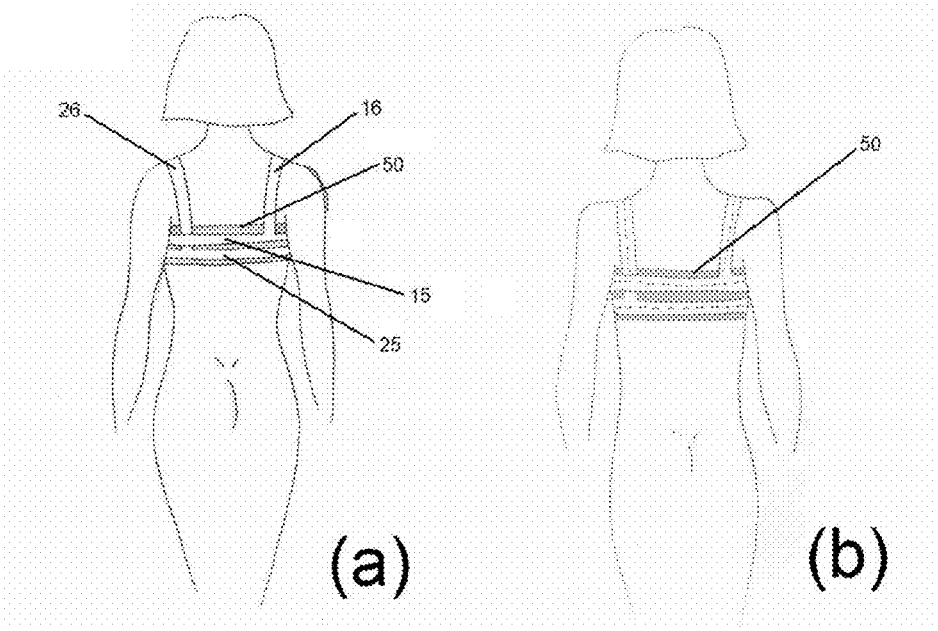
FIG. 5 provides a back view of an embodiment of the cross cut band.

The shoulder loops may be formed in such a way to balance orthopedic value, comfort, and breast visual appearance. Embodiments of the shoulder loops are shown in FIGS. 3*a-c*. For the purposed of this discussion, the shoulder loop configurations will be named rectangular, v-shaped, and x-shaped, respectively. Please note that such terms are not exact as such shapes may not be fully formed. The rectangular shoulder loop configuration, shown in FIG. 3*a*, may sacrifice some orthopedic value in order to allow the wearer to increase the visual appearance of their back, thereby allowing for a wearer's back to be at least partly exposed. The v-shaped shoulder loop configuration, shown in FIG. 3*b*, provides more orthopedic effect than the rectangular shaped configuration. The x-shaped shoulder loop configuration, shown in FIG. 3*c*, provides more orthopedic benefits than either the rectangular shape configuration or the v-shaped configuration. A cross cut band 50, as shown in FIGS. 5*a* and 5*b*, may be used to assist, either independently or in conjunction with (an)other component(s), positioning the shoulder loops. The shoulder loops may be attached to the breast cup either directly or via the breast cup connector.

One end of the cross straps may attach to any portion, or the entire portion, of the outer, distal, edge of the cup or cup connector. For example, the second cross strap end 28, may connect to the bottom portion of the second breast cup connector 29. It should be noted that the end of the relative second cross strap end 28 connection location to the second breast cup 20 or second breast cup connector 29 may differ from an end of the first cross strap end 18 connection location to the first breast cup 10 or the first breast cup connector 19. Using the embodiment of the end of the second cross strap end 28 being connected to the lower portion of the cup connector 29, described above, an example differing attachment location of the end of the first cross strap end 18 is a location above that of the end of the second cross strap end 28. As a further example, the lower end of the first cross strap end 18 can be positioned just above the corresponding end of the second cross strap end 28 attachment location.

In one embodiment, shown in FIGS. 5*a* and 5*a*, a cross cut band 50 is provided. The cross cut band 50 provide numerous realized benefits, for example augmenting breast visual appearance and increasing the ability to form various shoulder loop configurations, for example the configurations described above. The cross cut band 50 may circumscribe a user, below their breast area and across their mid-back. The cross cut band 50 may be attached to the first cross strap 15 and/or the second cross strap at one or more locations. The cross cut band 50 may be additionally or alternatively attached to the first shoulder loop 16 and/or the second shoulder loop 26. In another embodiment of the invention, the cross cut band 50 may further comprise one or more channels. Within the channels, the cross straps and/or shoulder loops may be placed. Alternatively, stiff mobile cords can be placed within the channels.

In an embodiment of the invention, a plurality of shoulder loop fasteners (not shown) are provided. The plurality of shoulder loop fasteners allow the user to adjust the configuration of the shoulder loops. A preferred embodiment of the shoulder loop fasteners is a hook and loop fastener. The hook and loop fastener can take any number of forms. For example, one or more hooks can be placed on a shoulder part of the shoulder loop while a plurality of loops run along a portion of the lower shoulder loop strap. This hook and loop structure allows for fixed positioning of the shoulder loop to tailor to one's specific orthopedic needs. The hook and loop structure may also take the form of a hook and loop fastener commonly known in the art as Velcro®. For example, the hooks may be placed on an end of the shoulder loop and the fabric loop portion can be placed along a portion of the cross strap. Utilizing this hook and loop fastener allows for positioning anywhere along the shoulder strap, thereby allowing one to tailor to his or her specific orthopedic needs, while leaving the ability to also tailor to one's comfort and beauty needs.

The embodiment shown in FIG. 1 further shows a first cross strap 15 and a second cross strap 25. One end of the cross straps are connected to the inner, medial/proximal, end of the breast cup while the other end is connected to the outer, distal, end of the same breast cup. For example, an end of the first cross strap 15 may be connected to the lower first inner edge 12 of the first breast cup 10 and an opposite end of the first cross strap 15 may be connected to the first upper outer edge 14 of the breast cup, either directly or via the first breast cup connector 19.

At a portion of the cross strap near the attachment to the inner edge of the breast cup, a cross strap angling is provided. An embodiment of a plurality of cross strap anglings is provided in FIG. 2. A first cross strap angling 13 and a second cross strap angling 23 is provided. The angling degree of the cross strap angling(s) should be such that it allows for properly enhancing the visual appearance of the breast while still providing sufficient orthopedic and comfort properties. It is preferred that the upper, superior, angle of the cross strap angling is an obtuse angle. Though the degree of angling may vary depending on the need of the user, it has been found through experimentation that an angle between 90 and 170 degrees is preferred. More preferably, an obtuse angle of between 90 and 150 degrees, still more preferably between 110 and 145 degrees, is used.

Figure 2:
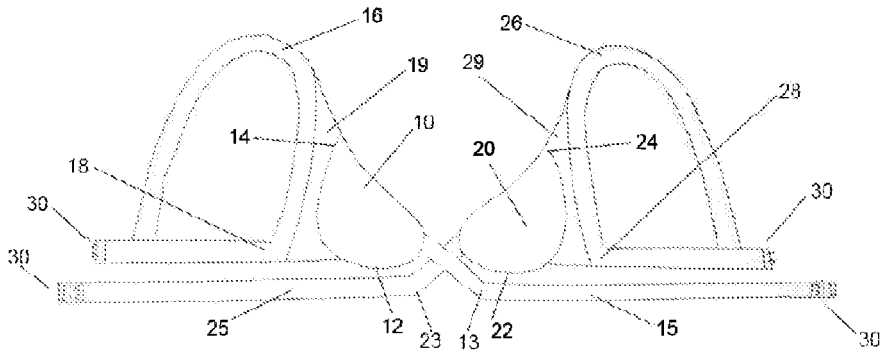
FIG. 2 provides a spread out view of an embodiment of the invention.
Figure 4:
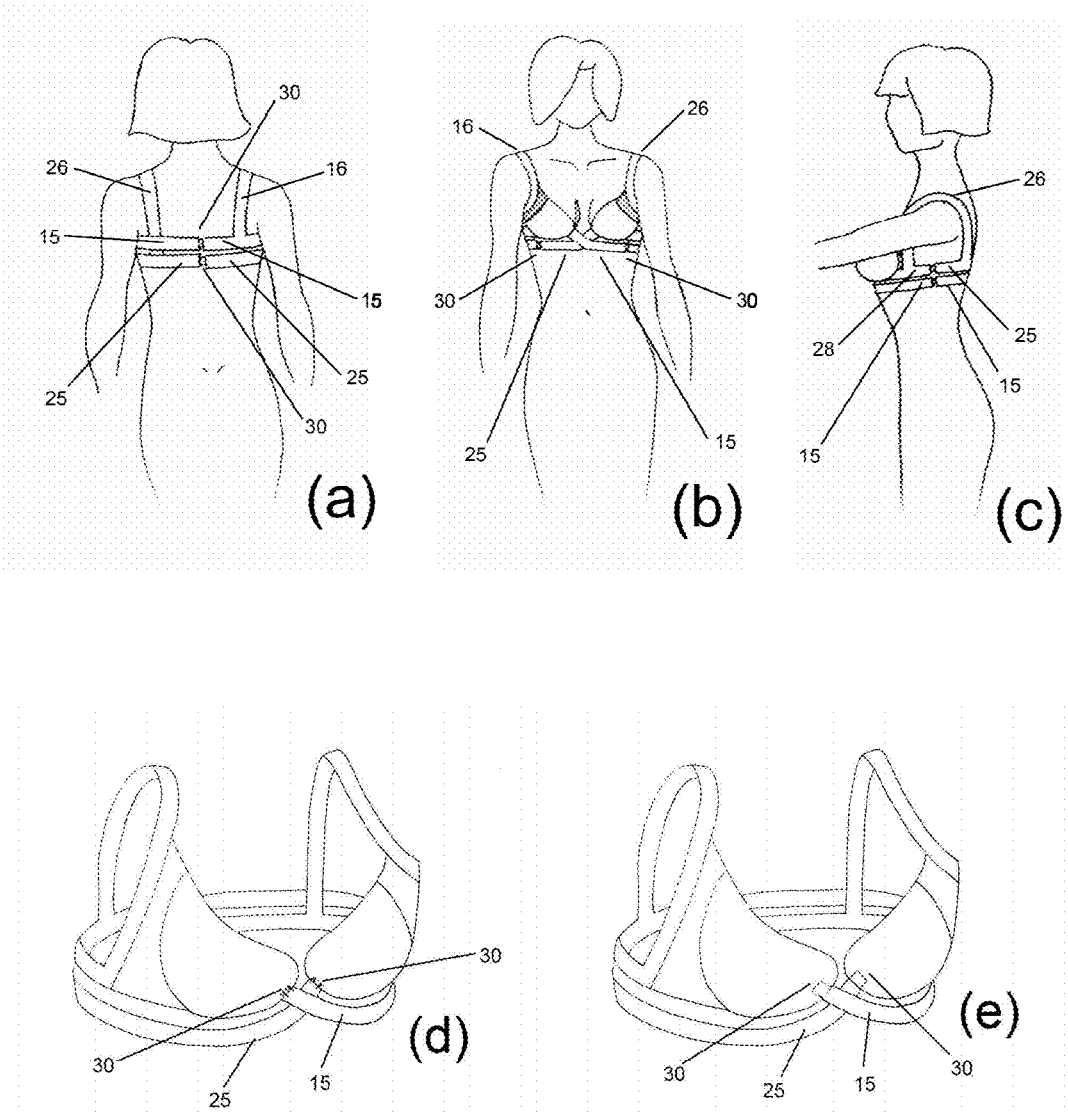
FIG. 4 provides various views of various embodiments of the cross strap fastener locations.

The embodiment shown in FIG. 2 provides a cross strap fastener 30. One or more cross strap fasteners 30 may be present. The cross strap fastener 30 may take any number of forms well known in the art. For example, a hook fastener or a clasp fastener may be used. Alternatively, a hook and loop fastener, commonly known as Velcro®, can be used. The location of the cross strap fastener 30 may vary in different embodiments of the invention. Examples of the various locations are shown in FIGS. 4*a-e*. Other locations than the ones described in the document have been conceptualized and realized. FIG. 4*a* shows an embodiment of the cross strap fastener 30 located at approximately the middle of a wearer's back. This embodiment would cause the cross strap fastener to be located approximately half way down the length of the cross strap. FIG. 4*b* shows an embodiment of the invention in which the cross strap fastener 30 is located along the cross straps, but unevenly separating the cross strap. This embodiment has the cross strap fastener located in the front of one's body and below the breast cups. The embodiment in FIG. 4*c* shows the location of the cross strap fastener being along the side of one's body. It should be further noted that this embodiment is not mirror the location of the cross strap fastener 30 between the second and first cross straps. The figured embodiment shows one cross strap fastener 30 being located along the end of the first cross strap end 18 and another cross strap fastener 30 present along the second cross strap 15, at a location other than along the end of the second cross strap end 28. This embodiment has two cross strap fasteners along one and the same side of a user's body, in this case the left side. The embodiment shown in FIG. 4*d* show the location of the cross strap fasteners directly attaching the cross straps with the breast cups. More specifically, a hook fastener is used to directly connect the cross straps with the lower inner edges of the beast cups. The embodiment in FIG. 4*e* shows yet another example of potential cross strap fastener 30 locations. In this embodiment, the cross straps connect to an interior side of the breast cups. This may be accomplished, for example, by providing a hook and loop fastener, commonly known as Velcro®, to one end of the cross straps and to a portion of the interior side of the breast cups.

Figure 6:
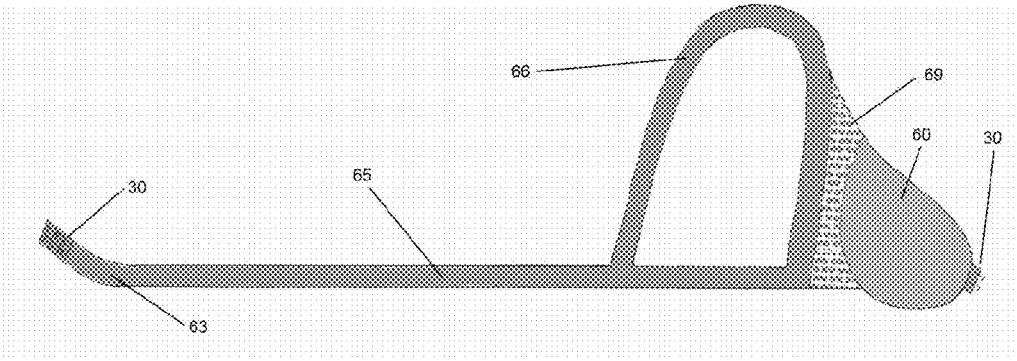
FIG. 6 provides a front view of an embodiment of the invention.
Figure 7:
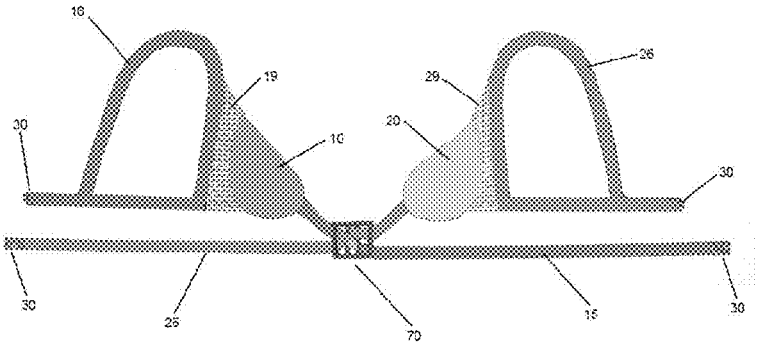
FIG. 7 provides a front view of an embodiment of the buckle.

FIG. 6 shows another embodiment of the invention. The embodiment provides a single breast covering device that is capable of assisting in correcting one's posture and stoop in one shoulder while simultaneously enhancing the visual appearance of a user's breast on the same side of the body as the shoulder being corrected. It should be noted that though only one garment is shown, a user may wear two such garments, the second garment being essentially a mirror image of the first garment. Two alternative, mirror image embodiments of the single garment are shown in FIGS. 8*a* and 8*b*. The embodiment in FIG. 7 shows a first breast cup 60. A first shoulder loop 66 is attached to one side of the single first breast cup 60 either directly or via the first breast cup connector. A first cross strap 65 is also connected to one side of the first breast cup 60, either directly or via the first breast cup connector 69. Optionally, the first cross strap 65 includes a first cross strap angling 63 towards an end of the first cross strap 65 opposite such end that is attached to the first breast cup 60 or first breast cup connector 69. Still further away from and on an opposite end of the first cross strap 60 connected to the first breast cup 60 or first breast cup connector is a portion of a single cross strap connector 30. The other part of the single cross strap connector 30 is located along the inner, medial, end of the single breast cup 60.

Figure 8:
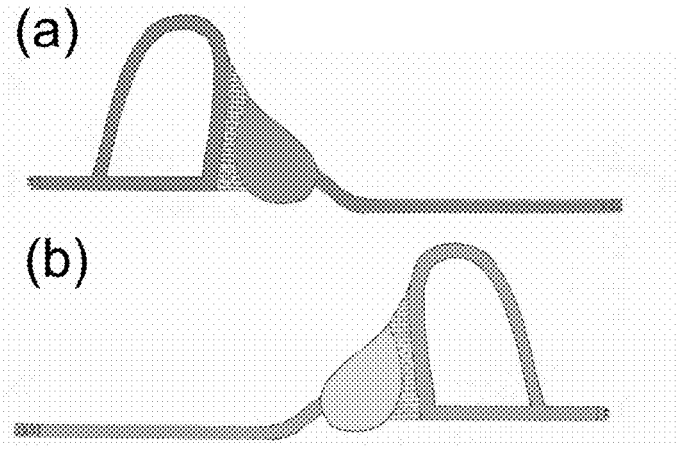
FIG. 8 provides a front view of an embodiment of the invention.

The first breast cup 10 and second breast cup 20 may further include a supporting and/or shaping structure 40, an embodiment of which is shown in FIG. 8. Potential embodiments of the supporting and/or shaping structure 40 are a pad or an underwire, but not limited to these potential options. For example, a pad may be shaped in such a way as to visually regulate the size of a wearer's breast or breasts. The supporting and/or shaping structure 40 can be integrally made as part of the cup, affixed to the cup, or temporarily held in place by the cup. Alternatively, the supporting and/or shaping structure 40 can be attached to a first cross strap 15. In one embodiment, the first cross strap 15 is attached to the supporting and/or shaping structure 40, preferably the inside of the supporting and/or shaping structure 40, and in such a way that the supporting and/or shaping structure 40 moves when the cross strap first 15 is pulled but the breast cup remains static or moves less than the supporting and/or shaping structure 40. If connected in such a way, one benefit is that the breasts will be visually enhanced via improving the push-up effect of the breasts. It will further assist in regulating the visual size of the breast. This is due to the appearance of additional cleavage while the cup maintains a full looking breast, especially along the outer, distal, and/or lower, inferior, side of the breast.

FIG. 7 provides an alternative embodiment of the invention. In this embodiment, a buckle 70 is further provided. The buckle may facilitate in adjusting the cross straps to allow for the desired effect of increasing one's breast appearance. The buckle 70 may be located at the area in which the first cross strap 15 and the second cross strap 25 overlap. This can be essentially between and below the breasts, essentially along the medial line of a user's body. While using a buckle 70, a user may be able to adjust each breast independent of the other breast.

In a further embodiment of the invention, a non-slip material may be placed along the entire or portion of the cross straps. For example, a non-slip substance may be placed along the interior side of a first cross strap 15, more preferably along a portion that will correspond to a wearer's side. The utilization of a non-slip material may assist in providing the necessary forces on the shoulders and breast, as the strength of the tissue is not equal.

In another embodiment of the invention, the device described within this document is used to provide orthopedic benefits while simultaneously increasing one's visual breast appearance. This can be accomplished by bringing the shoulders back while simultaneously lifting and/or bringing together one's breasts.

All the documents cited herein are incorporated into the invention as reference, as if each of them is individually incorporated. Further, it would be appreciated that, in the above teaching of the invention, the skilled in the art could make certain changes or modifications to the invention, and these equivalents would still be within the scope of the invention defined by the appended claims of the present application.

What is claimed is:

1. A functional garment comprising:

a first single breast covering device comprising:

a first breast cup;

a first shoulder strap;

a first breast cup connector comprising a first piece of material extending along a lateral side of the first breast cup, the first breast cup connector connecting, and being at least partially disposed between, the first breast cup and the first shoulder strap; and a first cross strap that is configured to extend around a portion of user's torso, the first cross strap having a first end portion that attaches to an inner edge of the first breast cup and a second portion which attaches to the first breast cup connector, wherein the inner edge of the first breast cup is configured to be disposed near a medial portion of the user's chest when the user wears the functional garment, and wherein the first breast cup is configured to support a first breast of the user.

2. The functional garment of claim 1, wherein said garment further comprises:

a second single breast covering device comprising:

a second breast cup;

a second shoulder strap; and a second cross strap that is configured to extend around a portion of user's torso, the second shoulder strap having a first end portion attaches to an inner edge of the second breast cup and a second portion which attaches to a second breast cup connector comprising a second piece of material extending along a lateral side of the second breast cup connector, the second breast cup connector connecting, and being at least partially disposed between, the second breast cup and the second shoulder strap, wherein the inner edge of the second breast cup is configured to be disposed near the medial portion of the user's chest when the user wears the functional garment, and wherein the second breast cup is configured to support a second breast of the user.

3. The functional garment of claim 1, wherein said garment further comprises a first cross strap angling along a portion of the first cross strap, wherein an angle of the first cross strap angling comprises an obtuse angle.

4. The functional garment of claim 1, wherein said first single breast covering device further comprises a first cross strap connector, at least partially located at some point along a length of the first cross strap.

5. The functional garment of claim 2, wherein said first single breast covering device further comprises a first cross strap connector, wherein said second single breast covering device comprises a second cross strap connector, wherein both the first and second cross strap connectors are configured to be located on a common lateral side of a user's body.

6. The functional garment of claim 1, wherein said garment further comprises: a first cross strap angling along a portion of the first cross strap, wherein an angle of the first cross strap angling comprises an obtuse angle that is configured to cause a portion of the first cross strap to run lower than the single breast when the first single breast covering device is worn.

7. The functional garment of claim 2, wherein said garment further comprises: a buckle located at an intersection of the first and second cross straps.

8. The functional garment of claim 1, wherein said garment further comprises: a cross cut band connected to the first cross strap, the cross cut band being configured to: circumscribe a user's body, pass under the first breast, and pass horizontally along the user's back.

9. The functional garment of claim 1, wherein said first breast covering device further comprises: a structure configured to provide at least one of support and shape to the single breast, wherein the first end portion of the first cross strap is configured to be connected to an inner edge of the structure instead of the inner edge of the first breast cup.

10. A single breast garment comprising:

a first single breast covering device comprising:

a first breast cup;

a first breast cup connector comprising a first piece of material extending along a lateral side of the first breast cup;

a first cross strap configured to extend around a torso of a user, wherein a first part of the first cross strap attaches to an inner edge of the first breast cup, and wherein the inner edge of the first breast cup is configured to be disposed near the medial portion of the user's chest when the user wears the functional garment, and a first shoulder loop strap, wherein the first shoulder loop strap extends from a first portion of the first cross strap and connects at a second portion of the first cross strap to form a first shoulder loop, and wherein the first breast cup connector connects, and is at least partially disposed between, the first breast cup and the first shoulder strap.

11. A method of simultaneously providing orthopedic benefits and breast enhancement, the method comprising:

providing a first single breast covering device comprising:

a first breast cup; and a first cross strap configured to extend around a torso of a user, wherein the first cross strap has a first part that is configured to be attached to an inner edge of the first breast cup; and a first shoulder loop strap, wherein the first shoulder loop strap extends from a first portion of the first cross strap, is connected to, and extends along, a lateral side of the first breast cup, and connects at a second portion of the first cross strap to form a first shoulder loop, wherein the first single breast covering device is configured to support a single breast;

wearing the first single breast covering device such that:

the first breast cup holds the single breast, such that first cross strap extends around a portion of the user's torso, and such that the first shoulder loop extends over a first shoulder of the user and places a first force on the user's first shoulder in such a way as to perform at least one of:

bringing the first shoulder back, and bringing a shoulder blade of the first shoulder closer to a medial line of the user's back; and wearing the first single breast covering device such that:

the first cross strap extends around the portion of the user's torso, the first shoulder loop extends over the user's first shoulder, and the first breast cup holds the single breast and places a second force on the single breast in such a way as to perform at least one of:

bringing the single breast closer to a medial line of the user's chest, and lifting the single breast.

12. The functional garment of claim 2, wherein the first breast cup, the first shoulder strap, the first breast cup connector, and the first cross strap are coupled together such that when the functional garment is worn by the user, the garment is configured to provide a force that visually enhances a user's breasts by at least one of bringing the user's breasts closer together and lifting the user's breasts, and that further performs at least one of:

bringing the user's shoulders back, and bringing the user's shoulder blades closer together.

13. The functional garment of claim 2, wherein the first breast covering device and the second breast covering device are adjustably connected to each other via a buckle that is disposed at an intersection between the first and second cross straps.

14. The functional garment of claim 1, wherein an interior surface of the first cross strap, which is configured to face towards a user's chest, comprises a non-slip material.

15. The functional garment of claim 8, wherein the cross cut band comprises a channel through which at least one of the first cross strap and a shoulder strap of the first breast covering device extends.

16. The functional garment of claim 15, wherein the first cross strap passes through the channel of the cross cut band, and wherein the first cross strap comprises a stiff mobile cord.

17. The functional garment of claim 2, wherein the first and second shoulder straps intersect with each other across a user's back when the user is wearing the first and second breast covering devices.

18. The functional garment of claim 10, wherein said garment further comprises:

a second single breast covering device comprising:

a second breast cup;

a second breast cup connector comprising a second piece of material extending along a lateral side of the second breast cup;

a second cross strap configured to extend around the user's torso, wherein the second cross strap has a second part that is configured to be attached to an inner edge of the second breast cup, and wherein the inner edge of the second breast cup is configured to be disposed near the medial portion of the user's chest when the user wears the functional garment; and a second shoulder loop strap, wherein the second shoulder loop strap extends from a first portion of the second cross strap and connects at a second portion of the second cross strap to form a second shoulder loop, and wherein the first breast cup connector connects, and is at least partially disposed between, the second breast cup and the second shoulder strap.

19. The functional garment of claim 18, wherein the first breast covering device and the second breast covering device are adjustably connected to each other via a buckle disposed at an intersection of the first cross strap and the second cross strap.

20. The method of claim 11, further comprising:

providing a second single breast covering device comprising:

a second breast cup, and a second cross strap configured to extend around the user's torso, wherein the second cross strap comprises a second part that is configured to be attached to an inner edge of the second breast cup; and a second shoulder loop strap, wherein the second shoulder loop strap extends from a first portion of the second cross strap, is connected to, and extends along a lateral side of the second breast cup, and connects at a second portion of the second cross strap to form a second shoulder loop, wherein the second breast covering device is configured to support a second breast that is different than the single breast; and wearing the second breast covering device such that: the second breast cup holds the second breast, the first cross strap extends around a portion of the user's torso, and the second shoulder loop extends over a second shoulder of the user.

* * * * *

UNITED STATES PATENT AND TRADEMARK OFFICE

CERTIFICATE OF CORRECTION

PATENT NO. : 9,265,288 B2
APPLICATION NO. : 13/977245
DATED : February 23, 2016
INVENTOR(S) : Sergei Mazourik et al.

Figure 10:
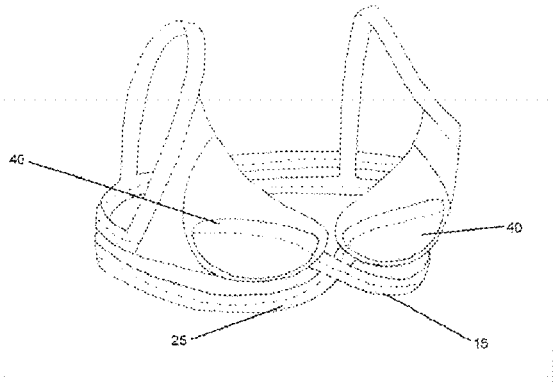
FIG. 10 provides a front view of an embodiment of the supporting and/or shaping structure.

It is certified that error appears in the above-identified patent and that said Letters Patent is hereby corrected as shown below:

In the Specification
Column 2, line 59, the word "closes" should be replaced with --closer--.
Column 4, line 23, the word "ones" should be replaced with --one's--.
Column 5, line 7, the word "purposed" should be replaced with --purpose--; and
Column 5, line 42, the phrase "shown in FIGS. 5a and 5a" should be replaced with --shown in FIGS. 5a and 5b--.
Column 6, line 12, the word "are" should be replaced with --is--; and
Column 6, line 56, the word "is" should be replaced with --does--.
Column 7, line 1, the word "beast" should be replaced with --breast--;
Column 7, line 18, the phrase "FIG. 7" should be replaced with --FIG. 6--; and
Column 7, line 34, the phrase "FIG. 8" should be replaced with --FIG. 10--.

In the Claims
Column 11, Claim 11, line 17, the phrase "such that first" should be replaced with --such that the first--.

Signed and Sealed this
Twenty-sixth Day of July, 2016

Michelle K. Lee

Michelle K. Lee
*Director of the United States Patent and Trademark Office*